United States Patent [19]

Sanchez

[11] 4,257,255

[45] Mar. 24, 1981

[54] APPARATUS FOR REPAIRING DEFORMED YIELDABLE STRUCTURES

[76] Inventor: Anastacio V. Sanchez, 10120 United Pl., Cupertino, Calif. 95014

[21] Appl. No.: 961,297

[22] Filed: Nov. 16, 1978

[51] Int. Cl.[3] ..... B21D 1/12

[52] U.S. Cl. ..... 72/455; 72/705

[58] Field of Search ..... 72/705, 457, 455; 254/124

[56] References Cited

U.S. PATENT DOCUMENTS

| | | | |
|---|---|---|---|
| 3,027,930 | 4/1962 | Padgett | 72/705 |
| 3,034,564 | 5/1962 | Cavazos | 72/705 |
| 3,059,785 | 10/1962 | Buckeye | 72/705 |
| 3,122,194 | 2/1964 | Bronson et al. | 72/705 |
| 3,149,659 | 9/1964 | Bogert, Jr. | 72/705 |
| 3,276,237 | 10/1966 | Transue | 72/705 |
| 3,338,083 | 8/1967 | Eck | 72/705 |
| 3,340,720 | 9/1967 | Chartier | 72/705 |
| 3,501,938 | 3/1970 | Sprague | 72/705 |
| 3,623,353 | 11/1971 | Dinnerman | 72/705 |
| 3,673,842 | 7/1972 | Sanchez | 72/705 |
| 3,689,030 | 9/1972 | Backus | 72/705 |
| 3,745,809 | 7/1973 | Sanchez | 72/705 |
| 3,749,364 | 7/1973 | Sanchez | 254/67 |
| 3,906,777 | 9/1975 | Dickens | 72/705 |
| 3,980,275 | 9/1976 | Sanchez | 254/67 |
| 4,088,006 | 5/1978 | Patten | 72/705 |
| 4,198,847 | 4/1980 | Russell et al. | 72/705 X |

FOREIGN PATENT DOCUMENTS

| | | | |
|---|---|---|---|
| 2227849 | 12/1973 | Fed. Rep. of Germany | 72/705 |
| 37143 | 9/1973 | Japan | 72/705 |
| 1332498 | 10/1973 | United Kingdom | 72/705 |

*Primary Examiner*—Lowell A. Larson

*Attorney, Agent, or Firm*—Jack M. Wiseman; Francis W. Anderson

[57] ABSTRACT

Portable apparatus for repairing deformed yieldable structures comprising an upright guide frame for cables and cable tensioning apparatus. The upright guide frame is adaptable to be removably disposed in a suitable post hole and includes a plurality of vertically spaced, horizontally disposed supports for receiving therebetween cables, cable tensioning apparatus and the like. At the bottom of the upright guide frame is a horizontal base that seats on a supporting surface. A guide frame for cables and cable tensioning apparatus is optionally pivotally connected to the upright guide frame, pivotally connected to the base adjacent to the upright guide frame, or detachably secured to the upright guide frame. Cables and cable tensioning apparatus are selectively removably attached to guide frames for attaching cables to a deformed yieldable structure for repairing the deformity.

17 Claims, 9 Drawing Figures

Fig. 2
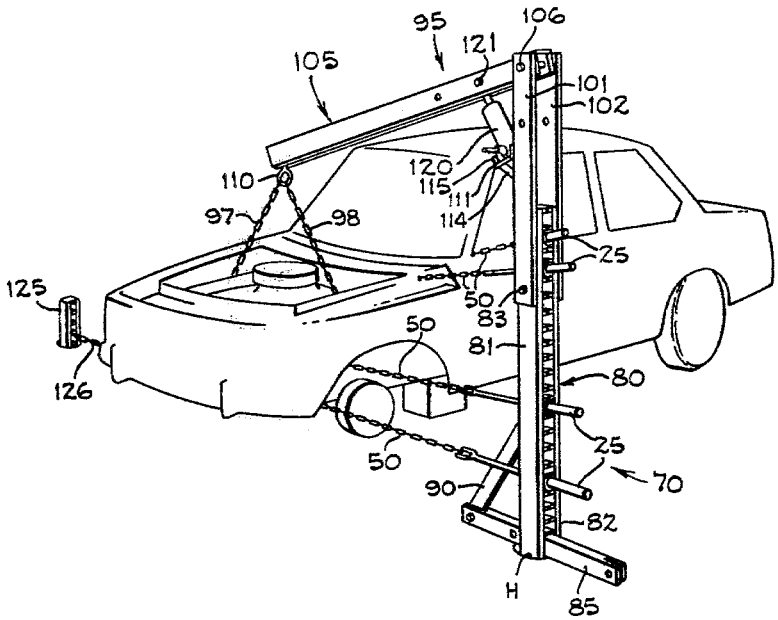
Fig. 5
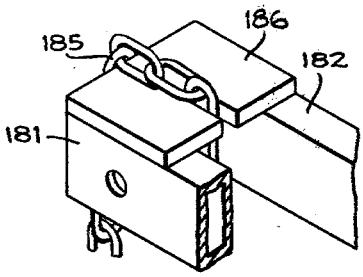
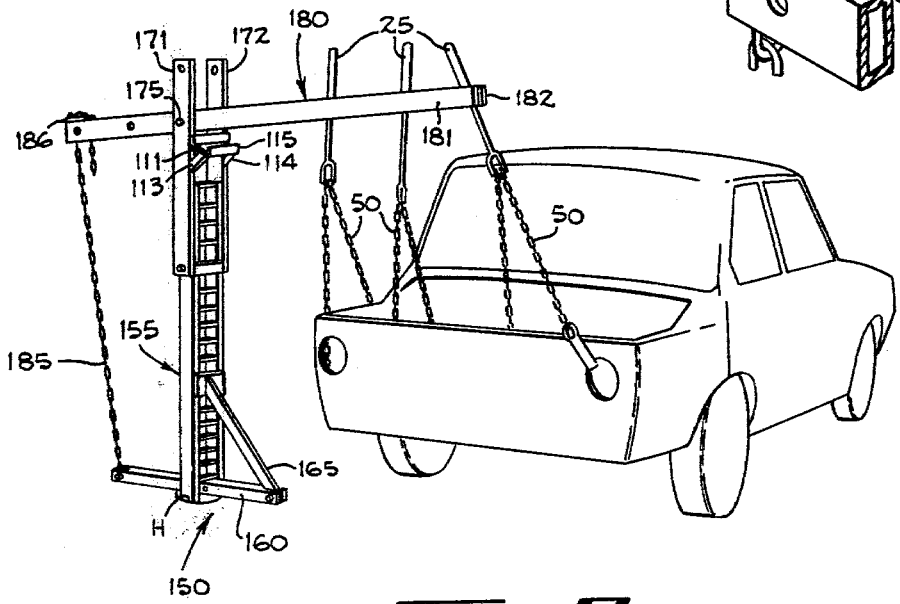
Fig. 3

FIG_4
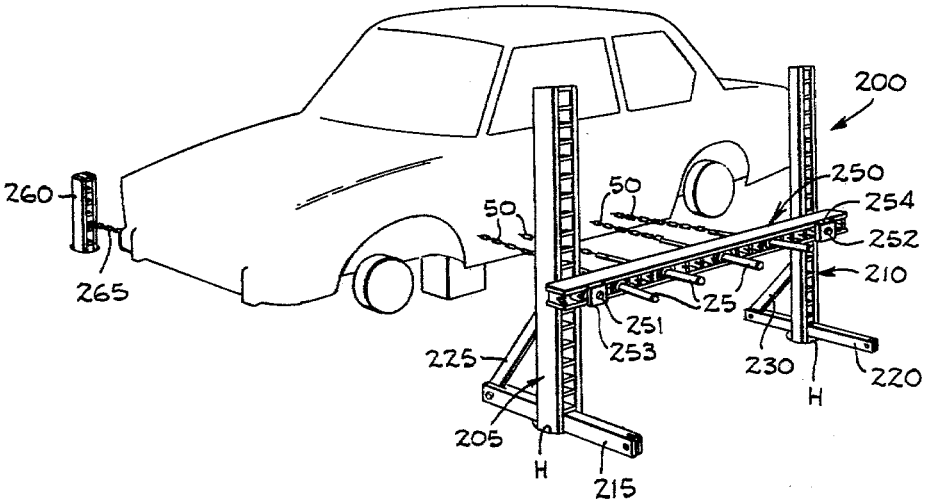
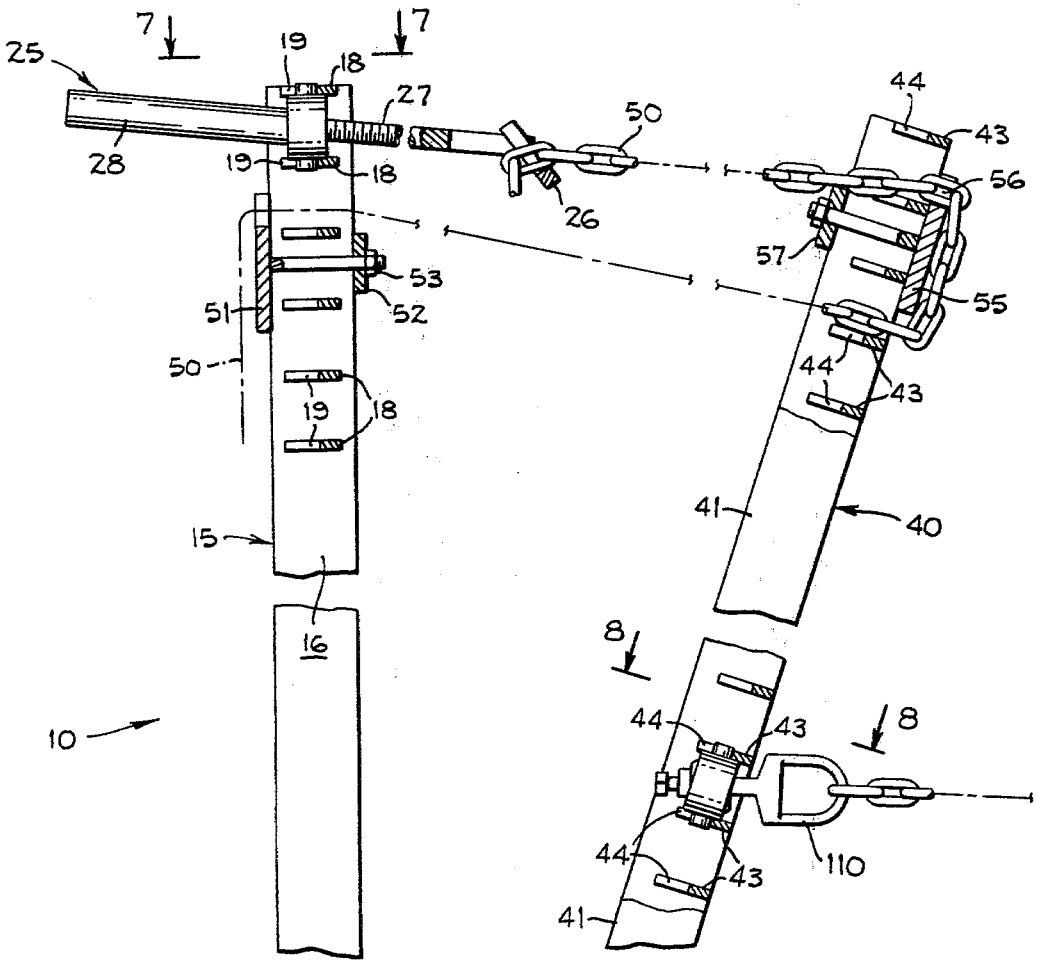
FIG_6

APPARATUS FOR REPAIRING DEFORMED YIELDABLE STRUCTURES

BACKGROUND OF THE INVENTION

The present invention relates in general to apparatus for repairing deformed yieldable structures and more particularly to portable apparatus for repairing deformed yieldable structures.

In the patent to Sanchez, U.S. Pat. No. Re. 28,370, issued on Mar. 25, 1975, for Method Of And Apparatus For Repairing Deformed Yieldable Structures, there is disclosed apparatus for repairing deformed yieldable structures in which upright guide members were employed that were removably attached to guide bars on horizontal guide bars. The patent to Sanchez, U.S. Pat. No. 3,980,275, issued on Sept. 14, 1976, for Cable Tensioning Apparatus discloses cable tensioning apparatus utilizing upright posts having a plurality of vertically spaced, horizontally disposed support plates.

The patent to Latuff et al., U.S. Pat. No. 3,377,834, issued on Apr. 16, 1968, for Automotive Vehicle Frame Straightening Device discloses chains extending across a number of pulleys, which are movable vertically along a subframe to attach the chain to the automotive vehicle at any desired angle. The subframe is also movable along frame members. The patent to Hunnicutt et al., U.S. Pat. No. 3,590,623, issued on July 6, 1971, for Method For Reforming And Straightening Members includes a platform. Hydraulic struts or rams are attached to the platform for rotary and pivotal movement for applying force to a chain attached to a deformed structure for repairing the same.

In the patent to Bogert, Jr., U.S. Pat. No. 3,149,659, issued on Sept. 22, 1964, for Automobile Repair Apparatus, there is disclosed a beam movable on casters. A pivot bar is attached to the beam and is formed with vertically spaced openings through which pass tensioning cables. A screw jack applies tension to the cables for repairing a deformed yieldable structure.

SUMMARY OF THE INVENTION

Apparatus for repairing deformed yieldable structures comprising an upright guide frame for supporting and directing cables and cable tensioning apparatus. The upright guide frame is adaptable to be removably disposed in a post hole. At the bottom of the upright guide frame is a horizontal base that seats on a supporting surface. The upright guide frame includes a plurality of vertically spaced, horizontally disposed support plates for receiving therebetween devices employed for applying tension to repair a deformed yieldable structure. A removably attached guide frame formed with longitudinally spaced support plates for receiving therebetween tension applying devices cooperates with the upright guide frame for selectively attaching cables to a deformed yieldable structure for repairing the deformity when the cable is subjected to tension.

By virtue of the present invention, the apparatus for repairing deformed yieldable structures has greater mobility, flexibility and versatility. In addition to being able to move the apparatus to various locations within a facility for more efficient use thereof, greater flexibility in the use of the apparatus is also provided. The greater flexibility affords the opportunity of reducing the size of the apparatus.

A feature of the present invention is that the apparatus for repairing deformed, yieldable structures is portable and still can be anchored to a supporting surface for greater stability.

DESCRIPTION OF THE DRAWINGS

FIG. 2 is a perspective view of a modification of the apparatus shown in FIG. 1.

FIG. 3 is a perspective view of a further modification of the apparatus shown in FIG. 1.

FIG. 4 is a perspective view of a still further modification of the apparatus shown in FIG. 1.

FIG. 5 is a fragmentary perspective view of the lever guide frame and cable employed in the apparatus shown in FIG. 3.

FIG. 6 is a fragmentary vertical sectional view taken through the guide frames employed in the apparatus shown in FIG. 1.

DESCRIPTION OF THE PREFERRED EMBODIMENT

Figure 1:
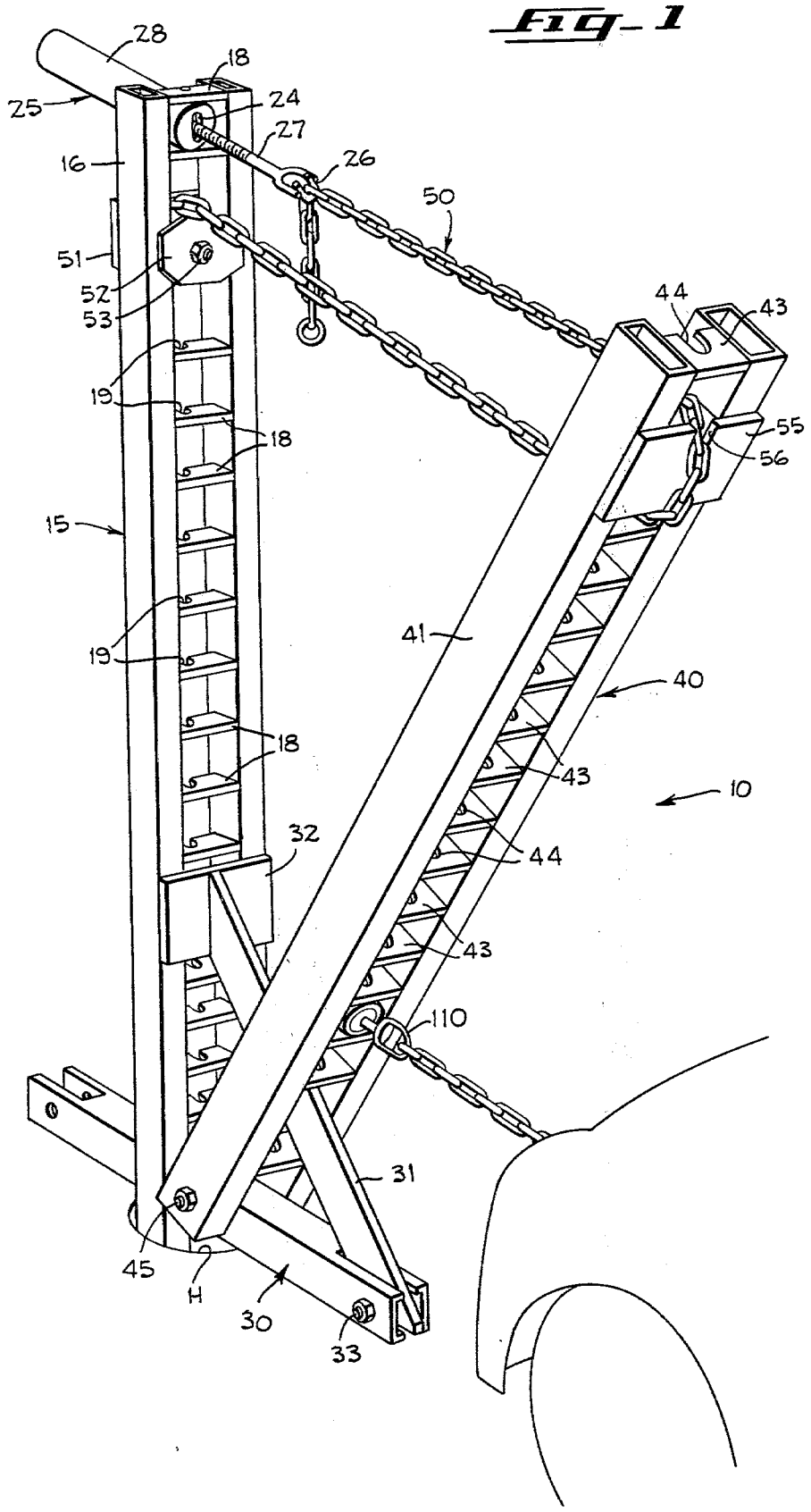
FIG. 1 is a perspective view of the apparatus for repairing deformed yieldable structures embodying the present invention.
Figure 7:
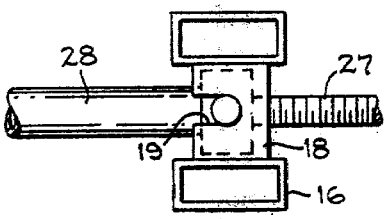
FIG. 7 is an elevation view taken along line 7—7 of FIG. 6.
Figure 8:
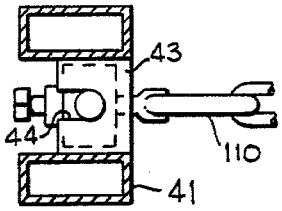
FIG. 8 is a vertical view taken along line 8—8 of FIG. 6.

Illustrated in FIGS. 1 and 6–8 is the apparatus 10 for repairing deformed, yieldable structures. The apparatus 10 comprises an upright guide frame 15 for supporting and directing cables and cable tensioning apparatus. The upright guide frame 15 is removably disposed in a suitable post hole H formed in a suitable supporting surface, such as concrete. In the exemplary embodiment, the upright guide frame 15 is made of a suitable metal, such as iron or steel. Included in the guide frame 15 are longitudinally extending members 16, which are spaced apart in the transverse direction. Interconnecting the upright members 16 are vertically spaced, horizontally disposed plates 18, which are made of a suitable metal, such as iron or steel. Generally, the support plates 18 are welded to the upright members 16 and 17. Each support plate 18 has a suitable opening 19, such as a recess or U-shaped opening, which receives an abutment member 24 of a cable tensioning apparatus 25. The patent to Sanchez, No. 3,980,275, issued on Sept. 14, 1976, for Cable Tensioning Apparatus discloses a cable tensioning apparatus and a guide frame for cables and cable tensioning apparatus.

At the bottom of the upright guide frame 15 is disposed a foot or a base 30 that is made of a suitable metal, such as iron or steel, for stabilizing the upright guide frame 15. The base 30 is welded to the confronting inner walls of the transversely spaced upright members 16. The base 30 seats on the concrete supporting surface in even contact therewith. In the exemplary embodiment, the upright members 16 are equidistance from the ends of the base 30.

Bolted to the base 30 by means of a nut and bolt arrangement 33 is a brace 31 that extends upwardly toward the upright guide frame 15. The brace 31 is bolted to the base 30 at the side thereof directed toward the deformed yieldable structure. An abutment plate 32 is welded to the distal end of the brace 31 and is welded to the confronting walls of the upright members 16 in even contact therewith. The brace 31 is made of a suitable metal, such as iron or steel.

Pivotally connected to the base 30 adjacent to the upright guide frame 15 is an angularly disposed guide frame 40 for supporting and directing cables and cable tensioning apparatus. The guide frame 40 projects at an adjustable angle upwardly from the foot of the upright guide frame 15 toward the deformed yieldable structure. Included in the angularly disposed guide frame 40 are longitudinally extending, transversely spaced members 41, which are made of a suitable metal, such as iron or steel. Welded to the confronting inner walls of the members 41 are longitudinally spaced support members 43, which are made of a suitable metal, such as iron or steel. Each support member has a suitable opening 44 formed therein, such as a recess or U-shaped opening, for receiving a suitable device at the end of a cable, such as metal swivel ring 110 (FIG. 6). In construction and use, the guide frames 15 and 40 are similar.

For pivotally mounting the guide frame 40 to the base 30 at the base of the guide frame 15, aligned openings are formed in the base member 30, and aligned openings are formed in the guide frame members 41. The base member 30 is disposed between the guide frame members 41. A nut and bolt arrangement 45 is disposed in the aligned openings of the base 30 and the aligned openings of the guide frame members 41.

To impart pivotal movement to the guide frame 40 toward the upright guide frame 15, a chain or cable 50 of iron or steel is anchored at one end to an anchor plate 51, which is at even contact with the members 16 of the upright guide frame 15. A U-shaped opening is formed in the anchor plate 51 for removably securing a link of the chain 50 thereto. Alternately, a hook can be welded to the plate 51 for removably securing a link of the chain 50 thereto. The anchor plate 51 is removably secured to the guide frame 15 by a plate 52 on the opposite face of the members 16 and 17 of the guide frame 15 through a nut and bolt arrangement 53. The chain 50 intermediate the ends thereof is looped around a plate 55 that engages the oppositely directed face of the longitudinal members 41 of the guide frame 40. A suitable slot 56 is formed in the plate 55 to receive the chain 50. A plate 57 on the opposite face of the members 41 of the guide frame 40 with respect to the plate 55 is secured thereto by a nut and bolt arrangement. The other end of the chain 50 engages a slotted cable retaining member 26 of the cable tensioning apparatus 25. In the preferred embodiment, the cable tensioning apparatus 25 is operated by an impact wrench, not shown, to tension the cable 50 for imparting pivotal movement to the guide frame 40 toward the upright guide frame 15.

The cable tensioning apparatus 25 is described in detail in the aforementioned patent to Sanchez, U.S. Pat. No. 3,980,275. Briefly, the cable tensioning apparatus has at one end thereof the U-shaped cable retaining member 26 to receive in locking engagement therewith the cable 50. Extending from the U-shaped cable retaining member is an integrally formed threaded rod 27. A threaded impact tube 28 receives the rod 27 in threaded engagement therewith. The free end of the impact tube 28 is suitably notched to receive a conventional air operated impact wrench.

In the use of the apparatus 10, cable tensioning apparatus 25 are located at selected locations along the inclined frame to apply a tension to cables 50. At the free end of the cables are suitable attachment tools to repair the deformed, yieldable structure. Suitable attachment and the operation in general is described in the patent to Sanchez, U.S. Pat. No. Re. 28,370, issued on Mar. 25, 1975, for Method Of And Apparatus For Repairing Deformed Yieldable Structures. Through the employment of the guide frame 40, an arrangement is provided for the attachment tools to apply a force to correct a deformity in a yieldable structure, such as a heavy frame.

Figure 9:
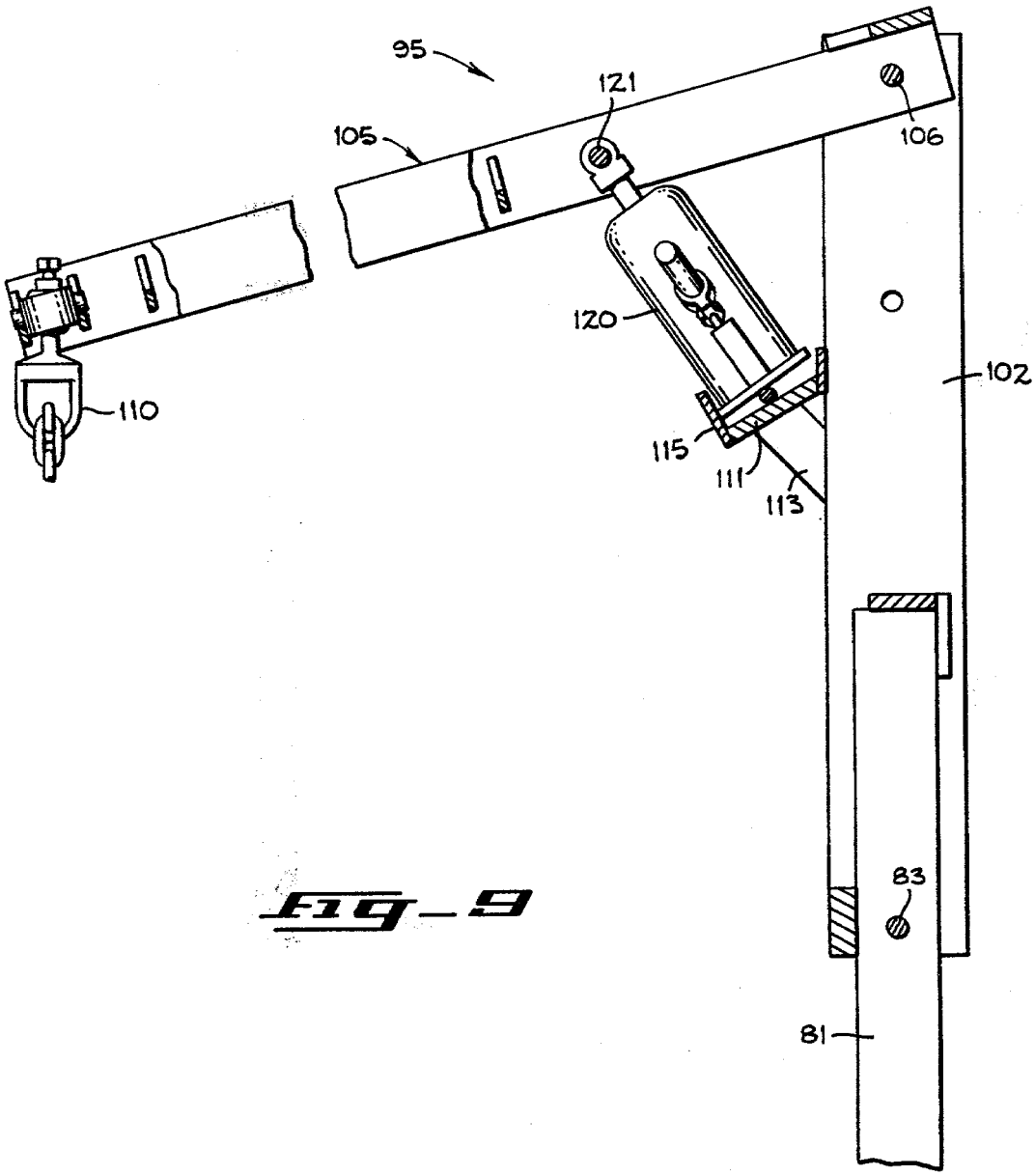
FIG. 9 is a sectional view with parts shown in elevation of the guide frames and jack employed in the apparatus shown in FIG. 2.

Illustrated in FIGS. 2 and 9 is a modification of the apparatus 10 shown in FIG. 1 for repairing deformed yieldable structures. The apparatus 70 (FIG. 2) comprises an upright guide frame 80, which is similar in construction and operation to the guide frame 15 (FIG. 1); a base 85, which is similar in construction and operation to the base 30 (FIG. 1); a brace 90, which is similar in construction and operation to the brace 31 (FIG. 1).

Bolted to the upright guide frame 80 is a guide frame 95 for guiding the direction at which cables, such as cables 97 and 98, apply a force to repair a deformed, yieldable structure. At the free ends of the cables 97 and 98 are suitable attachment tools of the type disclosed in the patent to Sanchez, U.S. Pat. No. Re. 28,370.

The guide frame 95 includes vertically disposed, transversely spaced attachment members 101 and 102, which are bolted to upright members 81 and 82 of the guide frame 80 by a nut and bolt arrangement 83. The attachment members 101 and 102 are made of a metal, such as iron or steel. The bolt is received by aligned openings in the members 101, 102, 81 and 82. The members 81 and 82 engage confronting inner walls of the members 101 and 102.

Pivotally connected to the attachment members 101 and 102 and disposed in the transverse space therebetween is a projecting guide frame 105 which is made of a suitable metal, such as iron or steel. A suitable nut and bolt arrangement 106 is received by aligned openings in the projecting guide frame 105 and the attachment members 101 and 102 to pivotally connect the proximal end of the projecting guide frame 105 to the upper portion of the members 101 and 102. Depending from the distal end of the projecting guide frame 105 is a metal swivel ring 110 (FIG. 9), which is made of a suitable metal, such as iron or steel, to which the links at the proximal ends of the cables 97 and 98 are hooked. The projecting guide frame 105 is similar in construction and use to the angularly disposed guide frame 40 of FIG. 1.

For moving the projecting guide frame 105 about the pivot arrangement 106, a metallic platform 111 (FIGS. 2 and 9) is welded to the members 101 and 102. Braces 113 and 114 of a suitable metal are welded to the platform 111 and the members 101 and 102. A flange 115 is welded to the free end of the platform 111. Seated on the platform 111 is a suitable hydraulic jack 120. The piston of the hydraulic jack 120 is pivotally connected through a nut and bolt arrangement 121 to the projecting guide frame 105. The base of the hydraulic jack 120 seats on a dowal fixed to the platform 111 to provide a limited tilting movement for the jack 120 to conform to a pivotal angle of the piston of the hydraulic jack. By operating the hydraulic jack 120, the projecting guide frame 105 is pivoted about the pivot arrangement 106.

In using the apparatus 70, it is contemplated that cables 50, cable tensioning apparatus 25, and attachment tools will be employed in connection with the guide frame 80 in a manner previously described for the guide frame 15 and in connection with the projecting guide frame 105 in a manner previously described for the angularly disposed guide frame 40. To anchor the vehicle while repair work is being performed, at least one upright guide frame 125 is disposed in a post hole and cables 126 interconnect the guide frame and the vehicle at the side of the vehicle opposite from the apparatus 70 to anchor the vehicle in place.

Illustrated in FIGS. 3 and 5 is a further modification of the apparatus 10 shown in FIG. 1 for repairing deformed, yieldable structures. The apparatus 150 (FIG. 3) comprises an upright guide frame 155, which is similar in construction and operation to the upright guide frame 80 (FIG. 2); a base 160 which is similar in construction and operation to the base 85 of FIG. 2; a brace 165 which is similar in operation and construction to the brace 90 of FIG. 2; and upright attachment members 171 and 172 which are similar in construction and operation to the attachment members 101 and 102 of FIG. 2.

Pivotally connected to the attachment members 171 and 172 by a nut and bolt arrangement 175 is a lever guide frame 180. The lever guide frame 180 is disposed between the transversely spaced, upright attachment members 171 and 172. The pivot guide frame 180 is similar in construction and use to the projecting guide frame 105 of FIG. 2 and comprises longitudinally extending, transversely spaced members 181 and 182. The pivot arrangement 175 is received by aligned openings in the members 171, 172, 181 and 182. The pivot arrangement 175 is now spaced downwardly from the top of the attachment members 171 and 172. The lever guide frame 180 includes transversely disposed, longitudinally spaced support members similar in construction and use to the support members 18 and 43 (FIG. 1).

At one end of the base 160, opposite from the brace 165, is secured in a suitable manner one end of a cable 185. The other end of the cable 185 is adjustably anchored to one end of the lever guide frame 180 by a plate 186 having a U-shaped opening (FIG. 5) to retain the lever guide frame 180 in an adjusted pivotal position. A link of the cable 185 is received by the U-shaped opening of the plate 186 to be anchored thereby. At the other end of the lever guide frame 180 are located cable tensioning apparatus 25 and cables 50. The operation of the cable tensioning apparatus 25 and the cables 50 have been heretofore described. The cables 50 in FIG. 3 have two free ends with attachment tools on each free end instead of a single free end as shown in FIGS. 1 and 2.

Illustrated in FIG. 4 is a still further modification of the apparatus 10 (FIG. 1) for repairing deformed yieldable structures. The apparatus 200 (FIG. 4) comprises spaced apart upright guide frames 205 and 210. The guide frames 205 and 210 are similar in construction and operation to the guide frames 15 (FIG. 1). At the bottom of the guide frame 205 is a base 215 and at the bottom of the guide frame 210 is a base 220. The bases 215 and 220 are similar in construction and operation to the base 30. Braces 225 and 230 are employed for the guide frames 205 and 210 in the manner heretofore described for the brace 31 in conjunction with the guide frame 15.

A horizontally disposed guide frame 250 is removably secured to the upright guide frames 205 and 210. The guide frame 250 is similar in construction to the guide frames 205 and 210, except that it is disposed horizontally rather than disposed vertically in a post hole. The guide frame 250 is bolted to the guide frames 205 and 210 through nut and bolt arrangements 251 and 252 and through back plates 253 and 254. There are four such back plates, although only two are shown. Back plates similar to back plates 253 and 254 are disposed on the opposite walls of the guide frames 205 and 210.

Cables 50 and cable tensioning apparatus 25 are employed in a manner heretofore described for repairing deformed yieldable structures. Vehicle anchoring guide frame 260 and cables 265 are employed in a manner heretofore discussed for guide frame 125 and cable 126 (FIG. 2). It is apparent that the vehicle anchoring guide frames and cables, such as guide frame 125 and cable 126 may be employed with the apparatus of the present invention when the anchoring of a vehicle is desired.

I claim:

1. Apparatus for supporting cable tensioning devices and for directing cables comprising:

(a) an upright guide frame seated in a post hole, said upright guide frame comprising transversely spaced, upright members, and transversely disposed, vertically spaced support members fixed to the confronting, inner walls of said upright members for forming spaces in which cable tensioning devices are respectively disposed to be supported by said upright guide frame; and (b) a rigid base fixed intermediate the ends thereof to said upright members at the lower portion thereof and resting on a supporting surface for stabilizing said upright guide frame.

2. Apparatus as claimed in claim 1 wherein said support members are respectively formed with openings to receive respectively an abutment member of a cable tensioning device.

3. Apparatus as claimed in claim 1 wherein said base comprises longitudinally extending, spaced parallel members fixed to the inner confronting walls of said upright members.

4. Apparatus as claimed in claim 3 and comprising an angularly disposed guide frame pivotally connected at its lower portion to said base and adjustable means interconnecting said upright guide frame and said angularly disposed frame for moving said angularly disposed frame toward said upright guide frame for applying tension to a cable anchored to said angularly disposed frame and connected to a yieldable structure.

5. Apparatus as claimed in claim 4 wherein said angularly disposed guide frame comprises longitudinally extending, transversely spaced members pivotally connected to said parallel members of said base with said parallel members of said base disposed between said longitudinally extending members, and transversely disposed, longitudinally spaced support members fixed to the confronting inner walls of said longitudinally extending members.

6. Apparatus as claimed in claim 5 wherein said angularly disposed guide frame is formed with openings for receiving respectively means for applying tension to a cable.

7. Apparatus as claimed in claim 6 wherein said adjustable means comprises a cable anchored at one end to said upright guide frame and looped around said angularly disposed guide frame intermediate the ends thereof, and a cable tensioning device supported by said upright guide frame and detachably connected to the other end of said cable for controlling the tension on said cable to move the angularly disposed guide frame toward said upright frame.

8. Apparatus as claimed in claim 1 and comprising attachment members detachably mounted on said upright guide frame.

9. Apparatus as claimed in claim 8 wherein said attachment members are in the form of longitudinally extending, transversely spaced attachment members detachably secured to said upright members, and said apparatus further comprising a projecting guide frame pivotally attached to said attachment members.

10. Apparatus as claimed in claim 9 wherein said projecting guide frame comprises longitudinally extending, transversely spaced members pivotally connected to said attachment members, and transversely disposed, longitudinally spaced support members fixed to confronting, inner walls of said longitudinal members of said projecting guide frame.

11. Apparatus as claimed in claim 10 wherein said upright guide frame and said projecting guide frame are respectively formed with openings to receive respectively cable tensioning devices.

12. Apparatus as claimed in claim 10 and comprising a platform fixed to said attachment members, and a jack seated on said platform, said jack including a shaft pivotally connected to said longitudinally extending member of said projecting guide frame for adjusting the angle of projection of said projecting guide frame relative to said attachment members.

13. Apparatus as claimed in claim 10 wherein said projecting guide frame is pivotally attached to said attachment members intermediate the ends of said projecting guide frame, and comprising cable means interconnecting one end of said projecting guide frame and said base for adjusting the angle of projection of said projecting guide means relative to said attachment member.

14. Apparatus for supporting cable tensioning devices and for directing cables comprising:

(a) an upright guide frame seated in a post hole, said upright guide frame comprising transversely spaced, upright members, and transversely disposed, vertically spaced support members fixed to the confronting, inner walls of said upright members for forming spaces in which cable tensioning devices are respectively disposed to be supported by said upright guide frame;

(b) a rigid base fixed intermediate the ends thereof to said upright members at the lower portion thereof and resting on a supporting surface for stabilizing said upright guide frame, said base comprising longitudinally extending, spaced parallel members fixed to the inner confronting walls of said upright members; and (c) a brace having one end thereof detachably secured to said parallel members and having the other end thereof extending upwardly in abutting engagement with said upright members.

15. Apparatus as claimed in claim 14 and comprising a second upright guide frame spaced from said first mentioned upright guide frame and seated in a post hole, said second upright guide frame comprising transversely spaced, upright members, and transversely disposed, vertically spaced support members fixed to the confronting inner walls of said upright members of said second upright guide frame; a second rigid base fixed to said second upright guide frame at the lower portion thereof and resting on a supporting surface for stabilizing said second upright guide frame, said second rigid base comprising longitudinally extending, spaced parallel members fixed to the inner confronting walls of said upright members of said second upright guide frame, a second brace having one end thereof detachably secured to said parallel members of said second rigid base and having the other end thereof extending upwardly in abutting engagement with said upright members of said second upright guide frame; and a horizontal guide frame detachably connected to said first mentioned upright guide frame and second upright guide frame.

16. Apparatus as claimed in claim 15 wherein said horizontal guide frame comprises longitudinally extending, transversely spaced members, and longitudinally spaced, transversely disposed support members fixed to said longitudinally extending members of said horizontal guide frame.

17. Apparatus as claimed in claim 16 wherein said first mentioned upright guide frame, said second upright guide frame and said horizontal guide frame are respectively formed with openings to receive a cable tensioning device.

* * * * *